US009865385B2

(12) United States Patent
Hirano

(10) Patent No.: US 9,865,385 B2
(45) Date of Patent: Jan. 9, 2018

(54) LINEAR SOLENOID

(71) Applicant: DENSO CORPORATION, Kariya, Aichi-pref. (JP)

(72) Inventor: Akinori Hirano, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/016,546

(22) Filed: Feb. 5, 2016

(65) Prior Publication Data

US 2016/0233013 A1 Aug. 11, 2016

(30) Foreign Application Priority Data

Feb. 10, 2015 (JP) ..... 2015-24637

(51) Int. Cl.
*H01F 7/16* (2006.01)

(52) U.S. Cl.
CPC ..... *H01F 7/1607* (2013.01); *H01F 2007/163* (2013.01)

(58) Field of Classification Search
CPC ..... H01F 7/1607–2007/163
USPC ..... 335/262
See application file for complete search history.

(56) References Cited

U.S. PATENT DOCUMENTS 3,735,302 A * 5/1973 Eckert ..... H01F 7/1607 335/262
6,489,870 B1 * 12/2002 Ward ..... H01F 7/081 335/220
2005/0218362 A1 10/2005 Furuta et al.
2011/0128104 A1 6/2011 Yasoshima

FOREIGN PATENT DOCUMENTS

| | | |
|---|---|---|
| JP | 2003-49963 | 2/2003 |
| JP | 2006-194351 | 7/2006 |
| JP | 2009-281469 | 12/2009 |
| WO | WO 2016/129261 | 8/2016 |

* cited by examiner

*Primary Examiner* — Ramon M Barrera
(74) *Attorney, Agent, or Firm* — Nixon & Vanderhye P.C.

(57) ABSTRACT

A linear solenoid has a coil, a plunger, a magnetic attractive core, and a magnetic delivery core. The coil generates a magnetic force when being energized. The plunger is supported to be movable in an axial direction on an inner side of the coil. The magnetic attractive core magnetically attracts the plunger in the axial direction by the magnetic force generated by the coil. The magnetic delivery core delivers a magnetic flux to an outer surface of the plunger. A shaft that is non-magnetic and extends in the axial direction is fixed on the inner side of the coil. The plunger has a shaft hole defined around an axial center of the plunger, and the shaft is inserted in the shaft hole. The plunger slides while being in contact with the shaft. One end of the shaft is fixed to the magnetically attractive core.

5 Claims, 3 Drawing Sheets

LINEAR SOLENOID

CROSS REFERENCE TO RELATED APPLICATION

This application is based on Japanese Patent Application No.2015-024637 filed on Feb. 10, 2015, the disclosure of which is incorporated herein by reference in its entirety.

TECHNICAL FIELD

The present disclosure relates to a linear solenoid.

BACKGROUND

A technique regarding a linear solenoid that has a plunger disposed on an inner side of a coil is disclosed in Patent Document 1 (JP 2011-119329 A). According to the linear solenoid of the Patent Document 1, a magnetic attractive core, a magnetic interruption part, and a magnetic delivery core are provided as a single member. The magnetic attractive core magnetically faces the plunger in an axial direction attracts the plunger. The magnetic delivery core has a tubular shape and surrounds the plunger. The magnetic delivery core delivers a magnetic flux to the plunger in a radial direction. The magnetic interruption part has a thin thickness and is a magnetically saturation part. The magnetic interruption part prevents the magnetic flux from directly flowing between the magnetic attractive core and the magnetic delivery core.

According to the linear solenoid of Patent Document 1, the magnetic attractive core and the magnetic delivery core are arranged on an inner side of a coil bobbin, and the plunger is arranged on an inner side of the magnetic attractive core and the magnetic delivery core. Accordingly, an outer diameter of the plunger is required to be small depending on a thickness of the magnetic attractive core and a thickness of the magnetic delivery core. Therefore, an area of a magnetic path of the plunger is restricted, and a magnetic attractive force of the plunger may be weakened.

SUMMARY

The present disclosure addresses the above issues, and it is an objective of the present disclosure to provide a linear solenoid, with which an outer diameter of a plunger that is disposed on an inner side of a coil can increase.

A linear solenoid of the present disclosure has a coil, a plunger, a magnetic attractive core, and a magnetic delivery core. The coil generates a magnetic force when being energized. The plunger is supported to be movable in an axial direction on an inner side of the coil. The magnetic attractive core magnetically attracts the plunger in the axial direction by the magnetic force generated by the coil. The magnetic delivery core delivers a magnetic flux to an outer surface of the plunger. A shaft that is non-magnetic and extends in the axial direction is arranged and fixed on the inner side of the coil. The plunger has a shaft hole defined around an axial center of the plunger, and the shaft is inserted to the shaft hole. The plunger slides while being in contact with the shaft. One end of the shaft is fixed to the magnetically attractive core.

According to the present disclosure, the outer diameter of the plunger can increase by a structure in which the plunger is supported by the shaft that is fixed to the magnetic attractive core. As a result, an area of a magnetic path of the plunger can increase, and a magnetic attractive force of the plunger can be greater.

BRIEF DESCRIPTION OF THE DRAWINGS

The above and other objects, features and advantages of the present disclosure will become more apparent from the following detailed description made with reference to the accompanying drawings.

DETAILED DESCRIPTION

Embodiments of the present disclosure will be described hereafter referring to drawings. In the embodiments, a part that corresponds to a matter described in a preceding embodiment may be assigned with the same reference number, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

Figure 1:
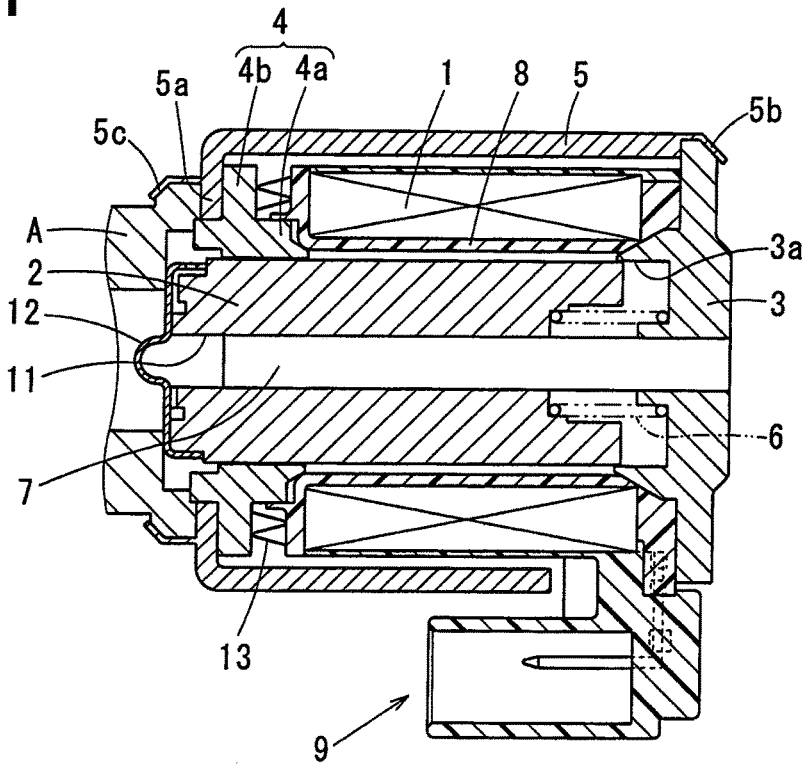
FIG. 1 is a sectional view illustrating a linear solenoid according to a first embodiment.

A first embodiment will be described referring to FIG. 1. In the following description, a left side in FIG. 1 will be referred to as left, and a right side in FIG. 1 will be referred to as right. In other words, a left-right direction will be defined on a basis of a left-right direction on a condition of being shown in FIG. 1. However, it should be noted that the left-right direction will be referred for a description purpose only, and it should not limit an actual direction on a condition of being mounted.

A linear solenoid of the present embodiment is used, for example in an electromagnetic hydraulic control valve that is disposed in a hydraulic controller for an automatic transmission. The electromagnetic hydraulic control valve has a hydraulic control valve (e.g., a spool valve or a ball valve) and a linear solenoid that are coupled with each other in an axial direction.

The hydraulic control valve is a three-way valve that is normally closed type or a normally opened type, and has a valve housing A such as a sleeve and a valve body such as a spool. According to the present embodiment, the linear solenoid has a return spring 6 that returns the valve body of the hydraulic control valve and a plunger 2 to an initial position. The return spring 6 may be disposed in the hydraulic control valve.

The linear solenoid has a coil 1, the plunger 2, a magnetic attractive core 3, a magnetic delivery core 4, a yoke 5, the return spring 6, and a shaft 7. The coil 1 generates a magnetic force when being energized. The plunger 2 is supported to be movable in an axial direction (i.e., a left-right direction) on an inner side of the coil 1 (i.e., in a range of an inner diameter of the coil 1). The magnetic attractive core 3 magnetically attracts the plunger 2 in the axial direction by the magnetic force generated by the coil 1. The magnetic delivery core 4 delivers a magnetic flux to an outer surface (i.e., a radial outer surface) of the plunger 2 in a radial direction. The yoke 5 covers around the coil 1 and magnetically couples the magnetic attractive core 3 and the magnetic delivery core 4. The return spring 6 biases the plunger 2 in a direction away from the magnetic attractive core 3 (i.e., toward left). The shaft 7 that is non-magnetic and extends in the axial direction is arranged and fixed at an axial center of the coil 1 on the inner side of the coil 1.

Elements of the linear solenoid will be hereafter described in detail.

The coil 1 is formed by winding an insulation-coated conductive wire (e.g., an enamel wire) around a bobbin 8 that is made of resin. The coil 1 generates magnetic force and provides a flux loop that passes a stator (i.e., the magnetic attractive core 3, the magnetic delivery core 4, and the yoke 5) and a movable member (i.e., the plunger 2) by a generated magnetic flux.

The coil 1 is energized through a connector 9. The connector 9 is a connection part that electrically connects to an electric control unit (i.e., an AT-ECU, not shown) through a connection wire. The electric control unit controls the electromagnetic hydraulic control valve. The connector 9 is made of a part of a secondary formation resin for molding the coil 1. The connector 9 therein has terminals that connect to both ends of the coil 1.

The plunger 2 is made of a magnetic metal (e.g., a ferromagnetic metal such as iron) to have substantially a cylindrical shape and is inserted to an inside of the coil 1. The plunger 2 has an outer diameter that is slightly smaller than an inner diameter of the bobbin 8, and is arranged such that the radial outer surface of the plunger 2 is not in contact with the bobbin 8 as much as possible.

The plunger 2 has a shaft hole 11 that is defined around an axial center portion (i.e., a center portion) of the plunger 2, and the shaft 7 is inserted to the shaft hole 11. The shaft 7 slide in contact with an inner surface of shaft hole 11. In other words, the shaft 7 is inserted to the shaft hole 11 such that the plunger 2 slides while being in contact with the shaft 7. Alternatively, in other words, the plunger 2 slides along the shaft 7 while an outer surface (i.e., a radial outer surface) of the shaft 7 is in contact with the plunger 2 defining the shaft hole 11. The shaft hole 11 is a circular hole that has a fixed diameter and extends in the axial direction in the axial center portion of the plunger 2 to pass through the plunger 2 in the axial direction. In other words, the shaft hole 11 has a circular shape in cross section and has a uniform diameter. The shaft hole 11 has an inner diameter that is slightly larger than an outer diameter of the shaft 7 such that a clearance is defined between the shaft hole 11 and the shaft 7, thereby the shaft 7 can slide in the shaft hole 11.

A cap 12 is attached to a left end surface of the plunger 2 and transmits a movement of the plunger 2 to the valve body of the hydraulic control valve. The cap 12 is, for example, made by pressing a metal plate such as a stainless plate to have a protruding portion that is located in a center portion of the cap 12 and protrudes leftward (i.e., toward the hydraulic control valve). An output from the plunger 2 is transmitted to the hydraulic control valve through the protruding portion.

A part of the magnetic attractive core 3 that excludes a tubular portion 3*a* is located on an outer side of the coil 1 in the axial direction, in other words, on a right side of the coil 1. According to the present embodiment, the part of the magnetic attractive core 3 is located only on the outer side of the coil 1 in the axial direction.

Specifically, the magnetic attractive core 3 is made of a magnetic metal (e.g., a ferromagnetic material such as iron) and has a generally circular plate shape. The magnetic attractive core 3 is fixed to a right end of the yoke 5 by a coupling method such as crimping and magnetically attracts the plunger 2 rightward. A void for magnetically attracting the plunger 2 is defined between the plunger 2 and the magnetically attractive core 3 in the axial direction.

The magnetically attractive core 3 has the tubular portion 3*a* that is capable of intersecting (i.e., overlapping) with the radial outer surface at a right end of the plunger 2 in the axial direction. The tubular portion 3*a* has an outer surface (i.e., a radial outer surface) in the radial direction. The radial outer surface of the tubular portion 3*a* is a tapered surface, and an outer diameter of the tubular portion 3*a* decreases toward left. Since the tubular portion 3*a* has the tapered surface, a magnetic attractive force that affects the plunger 2 is prevented from changing in conjunction with a stroke amount of the plunger 2.

The magnetic delivery core 4 is independent from, in other words, separated from the magnetic attractive core 3 and arranged on an outer side of the coil 1 in the axial direction, in other words, on the left side of the coil 1. According to the present embodiment, the magnetic delivery core 4 is arranged only on the outer side of the coil 1 in the axial direction.

Specifically, the magnetic delivery core 4 is made of a magnetic metal (e.g., a ferromagnetic material such as iron) and has a generally circular plate shape. The magnetic delivery core 4 is magnetically coupled with the yoke 5 on a left side of the yoke 5. A side void is defined between an inner surface (i.e., a radial inner surface) of the magnetic delivery core 4 and the radial outer surface of the plunger 2 in the radial direction. That is, an inner diameter of the magnetic delivery core 4 is larger than the outer diameter of the plunger 2. The magnetic delivery core 4 of the present embodiment is a ring member that has a generally T-shape in cross section. The magnetic delivery core 4 has a tubular portion 4*a* and an outer flange 4*b* that are integrated with each other. The tubular portion 4*a* has a tubular shape and covers the radial outer surface of the plunger 2 on the left side. The outer flange 4*b* protrudes radially outward from the tubular portion 4*a*.

On the other hand, the yoke 5 has an inner flange 5*a* that is provided by bending a left end portion of the yoke 5 radially inward. A right surface of the inner flange 5*a* and a left surface of the outer flange 4*b* are in contact with each other. Specifically, a spring member 13 is disposed between the bobbin 8 and the outer flange 4*b*. By restorative force of the spring member 13, a right end of the bobbin 8 is pressed against the magnetically attractive core 3, and the outer flange 4*b* is pressed against the inner flange 5*a*.

According to the present embodiment, the magnetic delivery core 4 is fixed to the yoke 5. Specifically, an inner periphery of the inner flange 5*a* defines a circular hole when viewed in the axial direction. An outer diameter of the tubular portion 4*a* coincides with an inner diameter of the inner flange 5*a*. By inserting the tubular portion 4*a* to abut on the inner flange 5*a*, a position of the magnetic delivery core 4 with respect to the yoke 5 is set such that an axial center of the magnetic delivery core 4 coincides with an axial center (i.e., a tubular center) of the yoke 5. That is, by attaching the magnetic delivery core 4 to the yoke 5, the magnetic delivery core 4 is centered, in other words, a position of an axial center of the magnetic delivery core 4 is adjusted.

The yoke 5 is made of a magnetic metal (e.g., a ferromagnetic material such as iron) and has a generally cylindrical shape. The yoke 5 covers around the coil 1, in other words, covers an outer periphery of the coil 1 and transmits a magnetic flux.

After assembling components of the linear solenoid in the yoke 5, a click portion 5*b* that is provided at the right end of the yoke 5 is crimped. In other words, the click portion 5*b* (i.e., a right end portion of the yoke 5) is bent radially inward after assembling the components of the linear solenoid in the yoke 5. Accordingly, the yoke 5 and the magnetic attractive core 3 are coupled strongly with each other.

The yoke 5 also has a click portion 5*c* at a left end of the yoke 5 to connect the valve housing A of the hydraulic control valve to the linear solenoid. By crimping (i.e., bending) the click portion 5*c* radially inward, the linear solenoid and the hydraulic control valve are coupled with each other.

The return spring 6 is a compression coil spring that biases the plunger 2 leftward, in other words, in the direction away from the magnetic attractive core 3. The return spring 6 is disposed between the plunger 2 and the magnetic attractive core 3 on a condition of being shrunk.

A bias force applied by the return spring 6 to the plunger 2 is also applied to the valve body of the hydraulic control valve. That is, the valve body of the hydraulic control valve and the plunger 2 of the linear solenoid return to an initial position by the bias force of the return spring 6.

The shaft 7 is, as described above, arranged and fixed at a center of the coil 1 on the inner side of the coil 1. According to the present embodiment, one end (i.e., a right end) of the shaft 7 is fixed to a center portion of the magnetically attractive core 3. A fixing method to fix the shaft 7 to the magnetic attractive core 3 is not limited, and press fitting, crimping, or welding may be used.

The shaft 7 is made of non-magnetic metal (e.g., stainless) and has an elongated cylindrical shape. The shaft 7 has a uniform diameter at least in a part that is inserted to the shaft hole 11. The shaft 7 is inserted into the shaft hole 11 of the plunger 2 such that the shaft 7 supports the plunger 2 to be slidable in the axial direction, and such that the shaft 7 prevents the plunger 2 from moving in the radial direction.

The shaft 7 is supported on a condition of being perpendicular to the magnetic attractive core 3. More specifically, the shaft 7 is fixed to the magnetic attractive core 3 to be perpendicular to a magnetic attractive surface of the plunger 2. Accordingly, by inserting the shaft 7 to the shaft hole 11 of the plunger 2, the plunger 2 is centered, in other words, a position of an axial center of the plunger 2 is adjusted.

The other end (i.e., a left end) of the shaft 7 is located between one end and the other end of the magnetic delivery core 4 in the axial direction. In other words, the other end of the shaft 7 overlaps with the magnetic delivery core 4 in the axial direction. Specifically, for example, an axial dimension (i.e., an entire length) of the shaft 7 is substantially the same as an axial dimension of the linear solenoid or slightly shorter than the axial dimension of the linear solenoid. The shaft 7 extends such that a left end of the shaft 7 is coincident with the left surface of the outer flange 4*b* of the magnetic delivery core 4.

According to the linear solenoid of the present embodiment, the shaft 7 is fixed to the magnetic attractive core 3 and supports the plunger 2. At least one of the part of the magnetic attractive core 3, which excludes the tubular portion 3*a*, and the magnetic delivery core 4 is located only on the outer side of the coil 1 in the axial direction. According to the present embodiment, both the magnetic attractive core 3, which excludes the tubular portion 3*a*, and the magnetic delivery core 4 are located only on the outer side of the coil 1 in the axial direction. As a result, the outer diameter of the plunger 2 arranged on the inner side of the coil 1 can increase.

The outer diameter of the plunger 2 can increase as compared to a conventional technique even when a tip (i.e., a rim) of the tubular portion 3*a* is located on the inner side of the coil 1 in the axial direction. Accordingly, the tubular portion 3*a* can be located on the inner side of the coil 1 in the axial direction, in other words, can overlap with the coil 1 in the axial direction.

Similarly, in a case where the tubular portion 4*a* has a tapered portion at an end (i.e., a right end) adjacent to the coil 1 (refer FIG. 1), a tip (i.e., a right rim) of the tapered portion can be located on the inner side of the coil 1 in the axial direction. In other words, the tip of the tapered portion can overlap with the coil 1 in the axial direction. Even when the tip of the tapered portion is located on the inner side of the coil 1 in the axial direction, the outer diameter of the plunger 2 can increase as compared to a conventional technique.

Specifically, even though an area of a magnetic path of the plunger 2 decreases when the shaft 7 is inserted, the area of the magnetic path of the plunger 2 can increases by greatly increasing the outer diameter of the plunger 2. Thus, by increasing the outer diameter of the plunger 2, the area of the magnetic path can increase enough to cancel a decrease of the area of the magnetic path due to inserting the shaft 7, thereby the magnetic attractive force of the plunger 2 can be improved.

By improving the magnetic attractive force of the plunger 2, a performance of the linear solenoid can be improved. When the physical size of the linear solenoid is the same extent as conventional technique, the output of the linear solenoid can increase according to the present disclosure. When an output of the linear solenoid is the same extent as conventional technology, the linear solenoid can be downsized according to the present disclosure.

According to the first embodiment, the magnetic attractive core 3 and the magnetic delivery core 4 are provided separately from each other. As a result, a magnetic interruption part that is used conventionally can be omitted. Therefore, a magnetic loss that is caused by a magnetic flux directly transmitted between the magnetic attractive core 3 and the magnetic delivery core 4 can be suppressed, and the magnetic attractive force of the plunger 2 can be improved as compared to conventional technique.

According to the first embodiment, the shaft 7 is fixed to the magnetic attractive core 3 as described above. As a result, the right end of the plunger 2 and the magnetically attractive core 3 can be arranged coaxially more accurately. Therefore, the void (i.e., an air gap in the radial direction) defined between an outer surface (i.e., a right end surface) of the plunger 2 on the right side and an inner surface (i.e., an axial inner surface) of the tubular portion 3*a* can decrease, and the magnetic attractive force of the plunger 2 can be improved more greatly.

According to the first embodiment, the shaft 7 has a free end (i.e., the left end) on a side away from the magnetic attractive core 3. As described above, the left end of the shaft 7 is located between the one end and the other end of the magnetic delivery core 4 in the axial direction.

As a result, the plunger 2 is centered, in other words, a position of the axial center of the plunger 2 is adjusted accurately on a left side, and the axial center of the plunger 2 at a left end is prevented from being displaced. Accordingly, a side force that is generated when the radial outer surface of the plunger 2 is magnetically attracted to the magnetic delivery core 4 can be suppressed.

Since the plunger 2 is centered accurately on the left side, the side void between the plunger 2 and the magnetic delivery core 4 can be decreased. Therefore, a magnetic efficiency of the linear solenoid can improved, and the magnetic attractive force of the plunger 2 can be further increased.

(Second Embodiment)

Figure 2:
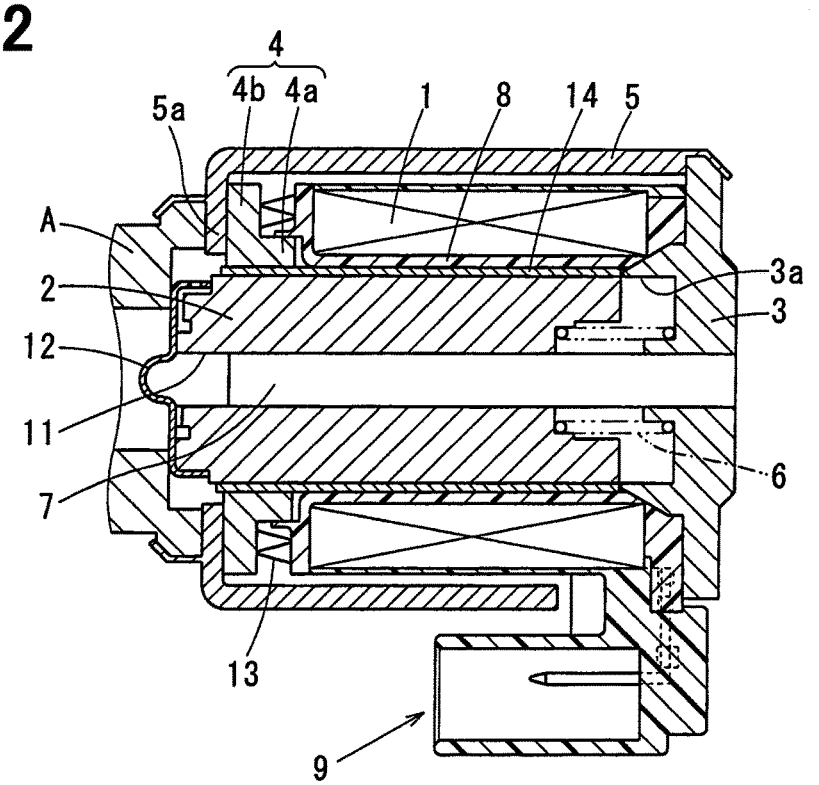
FIG. 2 is a sectional view illustrating a linear solenoid according to a second embodiment.

A second embodiment will be described referring to FIG. 2.

According to the second embodiment, a metal tube 14 that is non-magnetic, in other words, made of a non-magnetic metal is arranged on an inner surface (i.e., a radial inner surface) of the bobbin 8 in the radial direction. An inner diameter of the metal tube 14 is slightly larger than the outer diameter of the plunger 2. Specifically, the metal tube 14 is made of a thin non-magnetic metal plate (i.e., a thin metal plate made of a material such as stainless or brass) to have a tubular shape. The metal tube 14 is inserted into the bobbin 8 to be located on an inner side of the bobbin 8 in the radial direction.

When the bobbin 8 is expanded under an influence of heat or the like, the inner diameter of the bobbin 8 may be shrunk. By arranging the metal tube 14 of which inner diameter is slightly larger than the outer diameter of the plunger 2 on the inner side of the bobbin 8, the inner diameter of the bobbin 8 can be prevented from decreasing. Accordingly, an abnormality that the bobbin 8 interferes (i.e., interrupts) the plunger 2 by being shrunk can be suppressed. Thus, an abnormality that a sliding resistance of the plunger increases due to the interruption of the bobbin 8 with respect to the plunger 2 can be suppressed, and a reliability of the linear solenoid can be increased.

According to the second embodiment, the metal tube is arranged on the radial inner surface of the bobbin 8. That is, the metal tube 14 is arranged between the plunger 2 and the magnetic delivery core 4. The metal tube 14 maintains a dimension between the plunger 2 and the magnetic delivery core 4 to be minimum. In other words, the metal tube 14 secures a minimum distance between the plunger 2 and the magnetic delivery core 4.

Thus, by arranging the metal tube 14 between the plunger 2 and the magnetic delivery core 4, the minimum distance between the plunger 2 and the magnetic delivery core 4 can be controlled by a thickness of the metal tube 14. The minimum distance between the plunger 2 and the magnetic delivery core 4 is, in other words, a minimum dimension of the side void that is defined between the magnetic delivery core 4 and the plunger 2 in the radial direction. Therefore, the side force that is generated when the radial outer surface of the plunger 2 is magnetically attracted to the magnetic delivery core 4 can be maintained to be smaller than or equal to a specified value. As a result, a sliding movement of the plunger 2 can be prevented from deteriorating by an increase of the side force.

According to the second embodiment, the magnetic delivery core 4 is disposed to be slidable in the radial direction with respect to the yoke 5 on a condition of being in contact with the yoke 5. Specifically, according to the second embodiment, the magnetic delivery core 4 is a ring member that has an L-shape in cross section. Similar to the first embodiment, the magnetic delivery core 4 has the tubular portion 4*a* and the outer flange 4*b* that are provided integrally with each other. An outer diameter of the outer flange 4*b* is smaller than an inner diameter of the yoke 5, thereby the magnetic delivery core 4 can move in the radial direction in the yoke 5.

Similar to the first embodiment, the yoke 5 has the inner flange 5*a* that is provided by bending the left end portion of the yoke 5 radially inward. By restorative force of the spring member 13 that is disposed between the outer flange 4*b* and the bobbin 8, the left surface of the outer flange 4*b* is constantly pressed against the right surface of the inner flange 5*a*. Since the outer flange 4*b* is pressed against the inner flange 5*a*, the magnetic delivery core 4 and the yoke 5 are kept to be magnetically coupled with each other even when the magnetic delivery core 4 slides in the radial direction with respect to the yoke 5.

By the above-described structure, when the shaft 7 inclines by any cause, and when a force is generated at the left side of the plunger 2 to move the plunger 2 in the radial direction, the magnetic delivery core 4 slides in the radial direction by the force. Therefore, the plunger 2 can be prevented from pressing the magnetic delivery core 4 in the radial direction, thereby the sliding movement of the plunger 2 can be secured. As a result, a reliability of the linear solenoid can be increased.

(Third Embodiment)

Figure 3:
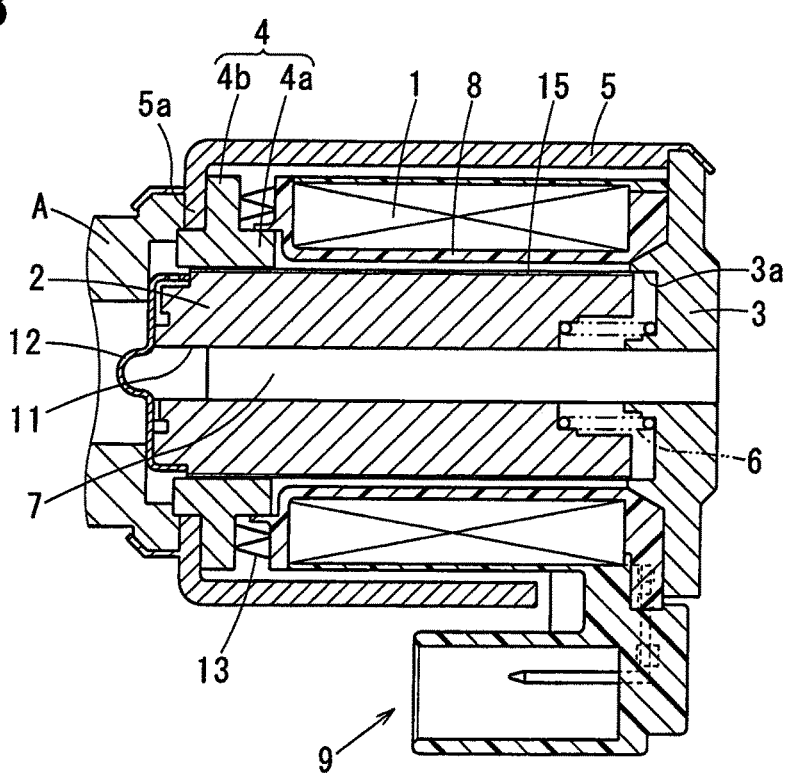
FIG. 3 is a sectional view illustrating a linear solenoid according to a third embodiment.

A third embodiment will be described referring to FIG. 3.

According to the third embodiment, a membrane member 15 that is non-magnetic, in other words, made of a non-magnetic material is arranged on the radial outer surface of the plunger 2.

The membrane member 15 is disposed (i.e., adhered) on the radial outer surface of the plunger 2 by a method such as plating or coating. The membrane member 15 may be made of a resin material such as Teflon (Trademark) or a metallic material such as copper or nickel.

According to the third embodiment, the same effects acquired by the second embodiment can be acquired with the membrane member 15 that is non-magnetic and arranged on the radial outer surface of the plunger 2.

(Fourth Embodiment)

Figure 4:
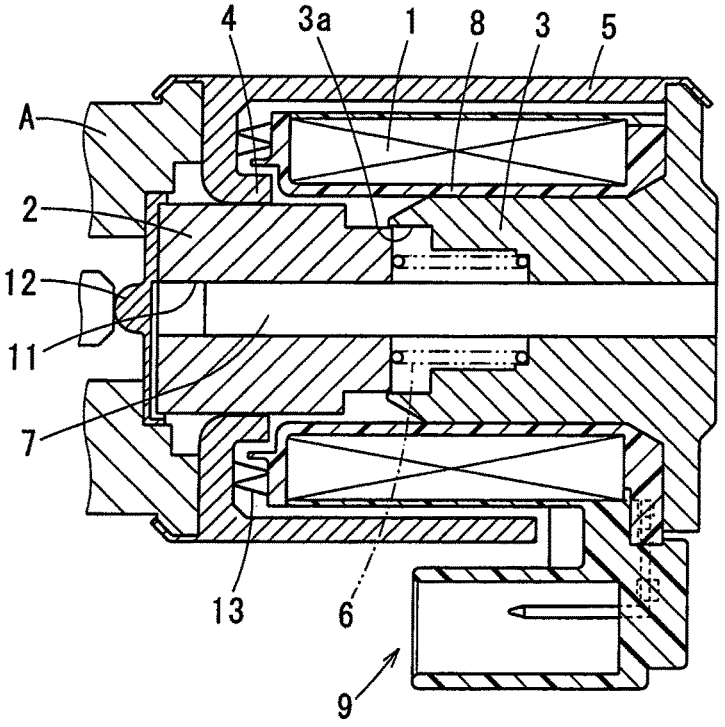
FIG. 4 is a sectional view illustrating a linear solenoid according to a fourth embodiment.

A fourth embodiment will be described referring to FIG. 4.

According to the first to third embodiment, both the magnetic attractive core 3 and the magnetic delivery core 4 are arranged only on the outer side of the coil 1 in the axial direction.

According to the fourth embodiment, only the magnetic delivery core 4 is located on the outer side of the coil 1 in the axial direction, and the magnetic attractive core 3 is located on the inner side of the coil 1 (i.e., overlaps with the coil 1) in the axial direction. Specifically, a part of the magnetic attractive core 3 that attracts the plunger 2 magnetically is located on the inner side of the coil 1 (i.e., overlaps with the coil 1) in the axial direction.

The same effect as the first embodiment can be acquired according to the fourth embodiment with the above-described structure.

According to the fourth embodiment and a fifth embodiment that will be described after, a quantity of components can be reduced by providing the magnetic delivery core 4 and the yoke 5 integrally.

(Fifth Embodiment)

A fifth embodiment will be described referring to FIG. 5.

According to the first to fourth embodiments, the magnetic attractive core 3 is located on the right side in the linear solenoid to move the plunger 2 in a direction (i.e., rightward) away from the hydraulic control valve by the magnetic force generated by the coil 1.

According to the fifth embodiment, the magnetic attractive core 3 is located on the left side in the linear solenoid to move the plunger 2 in a direction (i.e., leftward) approaching the hydraulic control valve by the magnetic force.

By arranging the magnetic attractive core 3 on a left side of the plunger 2, a driving force generated by the plunger 2 transmits leftward to the hydraulic control valve. In this case, the linear solenoid has a transmission part to transmit a movement of the plunger 2 to the hydraulic control valve.

An example of the transmission part will be described hereafter.

According to the fifth embodiment, the shaft hole 11 that is defined around the axial center of the plunger 2 extends from a left end of the plunger 2 to a position between the left end and a right end of the plunger 2. That is, the shaft hole 11 is a bottomed-hole, and the plunger 2 defines a bottom of the shaft hole 11 inside of the plunger 2.

The transmission part has a first sliding shaft 16 and a second sliding shaft 17. The first sliding shaft 16 is supported to be slidable in the axial direction on a radial inner side of a through hole that is defined around an axial center of the shaft 7. A right end of the first sliding shaft 16 abuts on the bottom of the shaft hole 11, in other words, on a part of the plunger 2 defining the bottom of the shaft hole 11. The second sliding shaft 17 is supported to be slidable in the axial direction on a radial inner side of a through hole that is defined around an axial center of the magnetic attractive core 3. A right end of the second sliding shaft 17 abuts on a left end of the first sliding shaft 16.

According to the fifth embodiment, the same effects as the first embodiment can be acquired.

Figure 5:
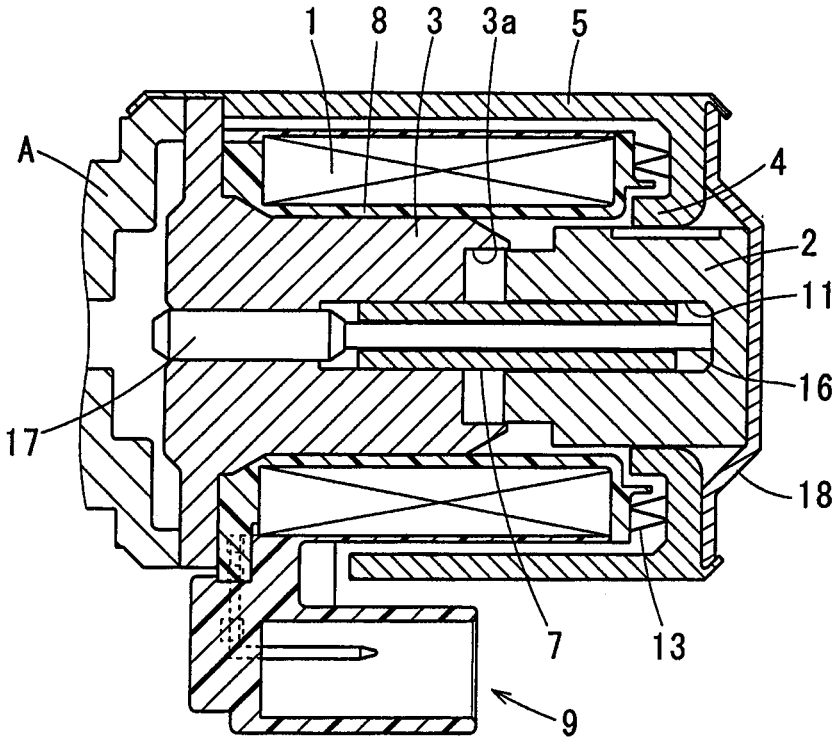
FIG. 5 is a sectional view illustrating a linear solenoid according to a fifth embodiment.

A numeral 18 shown in FIG. 5 is assigned to a seal plate that seals a right end of the linear solenoid.

In the above-described embodiments, the linear solenoid operates the hydraulic control valve. However, a subject to be operated by the linear solenoid is not limited to the hydraulic valve. The linear solenoid of the present disclosure may operate a subject other than a valve (e.g., the hydraulic valve) directly or indirectly.

Such changes and modifications are to be understood as being within the scope of the present disclosure as defined by the appended claims.

What is claimed is:

1. A linear solenoid comprising:

a coil that generates a magnetic force when being energized;

a plunger that is supported to be movable in an axial direction on an inner side of the coil;

a magnetic attractive core that magnetically attracts the plunger in the axial direction by the magnetic force generated by the coil; and a magnetic delivery core that delivers a magnetic flux to an outer surface of the plunger, wherein a shaft that is non-magnetic and extends in the axial direction is arranged and fixed on the inner side of the coil, the plunger has a shaft hole defined around an axial center of the plunger, and the shaft is inserted to the shaft hole, the plunger slides while being in contact with the shaft, one end of the shaft is fixed to the magnetically attractive core, and an other end of the shaft is located between one end and an other end of the magnetic delivery core in the axial direction.

2. The linear solenoid according to claim 1, wherein the coil is wound around a bobbin that is made of resin, and a metal tube that is non-magnetic and has an inner diameter that is larger than an outer diameter of the plunger is arranged on an inner surface of the bobbin.

3. The linear solenoid according to claim 1, further comprising:

a metal tube that is non-magnetic is located between the plunger and the magnetic delivery core.

4. The linear solenoid according to claim 1, further comprising:

a membrane member that is non-magnetic and arranged on the outer surface of the plunger.

5. The linear solenoid according to claim 1, wherein the magnetic delivery core is disposed to be slidable in a radial direction with respect to a yoke while being in contact with the magnetic delivery core.

* * * * *